US007306101B2

(12) United States Patent
Murry

(10) Patent No.: US 7,306,101 B2
(45) Date of Patent: Dec. 11, 2007

(54) DEVICE FOR HOLDING DECORATIVE STRING LIGHTS

(76) Inventor: Daniel L. Murry, 181 Brunswick Forge Rd., Troutville, VA (US) 24175

( * ) Notice: Subject to any disclaimer, the term of this patent is extended or adjusted under 35 U.S.C. 154(b) by 490 days.

(21) Appl. No.: 10/938,655

(22) Filed: Sep. 13, 2004

(65) Prior Publication Data

US 2006/0054760 A1 Mar. 16, 2006

(51) Int. Cl.
*B65D 85/00* (2006.01)

(52) U.S. Cl. ..... 206/408; 206/419

(58) Field of Classification Search ..... 242/395, 242/395.1, 400, 400.1, 405, 405.1, 405.2, 242/405.3, 404.3; 206/408, 409, 419, 420
See application file for complete search history.

(56) References Cited

U.S. PATENT DOCUMENTS 1,082,069 A * 12/1913 Clements ..... 242/400.1
1,085,729 A * 2/1914 Gore ..... 242/404.3
5,381,899 A * 1/1995 Rabbitt ..... 206/397
5,641,075 A 6/1997 Mechlin
5,676,250 A 10/1997 Walters
5,695,148 A 12/1997 Christensen
5,762,311 A 6/1998 Triglia
5,868,334 A 2/1999 Cedillo
5,924,570 A 7/1999 Sickles
5,957,401 A 9/1999 O'Donnell
6,056,226 A * 5/2000 Green ..... 242/395
6,059,215 A * 5/2000 Finnis ..... 242/400.1
6,237,769 B1 5/2001 Collom
6,431,489 B1 8/2002 Rose
6,467,623 B1 10/2002 Lewis
6,557,792 B1 * 5/2003 Snow ..... 242/395.1
6,612,436 B1 * 9/2003 Zullo ..... 206/391
6,783,093 B2 * 8/2004 Limber ..... 242/405.2
6,823,993 B1 * 11/2004 Cruze ..... 206/419
7,017,743 B1 * 3/2006 Patterson ..... 206/419
2004/0206846 A1 * 10/2004 Allen ..... 242/395.1

* cited by examiner

*Primary Examiner*—David T. Fidei
(74) *Attorney, Agent, or Firm*—Dinesh Agarwal, P.C.

(57) ABSTRACT

A device for holding a string-like member, such as a holiday decorative string light, includes a housing with an inside member for winding the string-like member thereabout, and multiple hangers extending outwardly from the housing. A string light, such as a rope light may be wound about the inside member of the housing, and an icicle light string or a net light can be supported from the hangers by winding externally about the housing.

21 Claims, 5 Drawing Sheets

DEVICE FOR HOLDING DECORATIVE STRING LIGHTS

BACKGROUND OF THE INVENTION

The present invention is generally directed to storage devices, and more particularly to a device for holding, protecting, storing, and/or shipping string lights commonly used in the adornment of trees and buildings.

Decorative lights typically adorn trees and buildings during the winter holiday season and are then removed and stored until the next year or next occasion of use. Original packaging is generally not reusable or not easy to reuse. Storing lights often leads to tangling, twisting and bending. Bulbs may become dislodged or break. Lights may be exposed to atmospheric contaminants, such as dust, and prone to damage from bugs and water, or they may be bumped, dropped, or crushed during storing and moving.

Traditionally, lights were only popularly formed in linear strings. However, newer forms of lights, including icicle lights, net lights, and rope lights, although provide the users with more decorative options, they have added to the problems. For instance, icicle lights and net lights more easily become entangled and lose their natural form, and rope lights can twist, bend, and break, making their storage after use more difficult. In addition, since these lights are folded or coiled into compact boxes for shipping, their use is very difficult as the user must first spread or stretch the lights into more manageable natural forms. Often the lights retain their folded or coiled shape due to memory, making the task of decorating, for example, a bush or tree, cumbersome.

Conventional devices for holding lights suffer from various drawbacks. The devices are not suitable for holding icicle lights, net lights, and/or rope lights, lack simplicity in design or use, and are not designed for holding, protecting, storing, and/or shipping of lights without entangling, twisting, bending, or breaking. Many of the devices are only designed for holding the traditional linear-string lights. Examples of devices for holding lights are shown in U.S. Pat. Nos. 5,641,075; 5,676,250; 5,695,148; 5,762,311; 5,868,334; 5,924,570; 5,957,401; 6,237,769 B1; 6,431,489 B1; and 6,467,623 B1.

In view of the drawbacks associated with conventional devices, there is a need in the industry for a simple, versatile device for holding, protecting, storing, and/or shipping of lights, including linear-string lights, icicle lights, net lights, and rope lights, without entangling, twisting, bending, or breaking.

OBJECTS AND SUMMARY OF THE INVENTION

The principal object of the present invention is to provide a device which overcomes the drawbacks associated with conventional devices.

Another object of the present invention is to provide a device which is versatile in that it can hold linear-string lights, icicle lights, net lights, and rope lights, individually or collectively in various combinations thereof.

Yet another object of the present invention is to provide a device which holds lights, protects lights, and facilitates the storing and shipping of lights, without entangling, twisting, bending, and/or breaking.

An additional object of the present invention is to provide a device which is simple in design and easy to use. In particular, the device can be easily carried up a ladder and the lights unwound therefrom by simply rotating while holding in one hand to decorate, for example, a home with icicle lights.

Yet an additional object of the present invention is to provide a device which allows for easy and convenient storage of decorative lights, particularly the icicle lights, rope lights, and/or net lights, after their use. The lights can be easily stored for later use without entangling, breaking, or twisting. The lights so stored can be very easily taken out from the device in substantially straight, untangled form for immediate use.

One of the above objects is met, in part, by the present invention, which in one aspect includes a device for holding a string-like member, including a housing with an inside member for winding a string-like member thereabout, and a plurality of hangers extending outwardly from the housing.

Another aspect of the present invention includes a device for holding a light string, which includes a generally cylindrical housing with a side opening for guiding a first light string thereinto. The housing includes an inside bottom projection for winding the first light string thereabout for storage. A plurality of angularly equilaterally spaced hangers extend outwardly from the exterior of the housing for holding a second light string. The second light string includes a plurality of icicle-light strands connected to a common strand. The second light string can be wound about the housing in a manner that the common strand is supported on the hangers and the icicle-light strands hang freely therefrom.

Another aspect of the present invention includes a containment unit for shipping and storing a light string, which includes a device for holding a light string, and an enclosure for housing the device. The enclosure includes an inside member for immobilizing the device within the enclosure.

BRIEF DESCRIPTION OF THE DRAWINGS

One of the above and other objects, novel features and advantages of the present invention will become apparent from the following detailed description of the preferred embodiment(s) of invention illustrated in the accompanying drawings, wherein.

DETAILED DESCRIPTION OF THE PREFERRED EMBODIMENT(S) OF THE INVENTION

Figure 1:
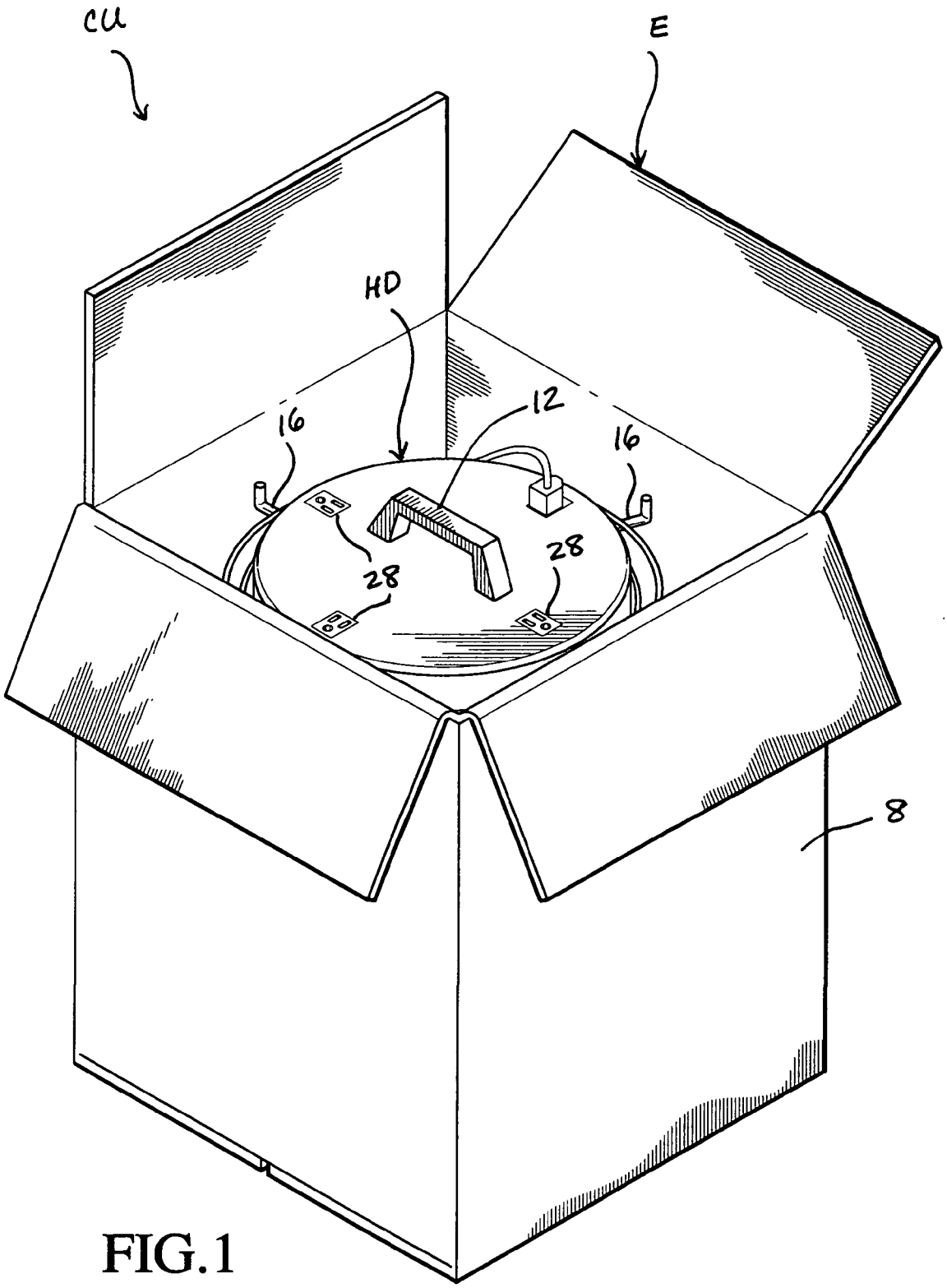
FIG. 1 is a top perspective view of a containment unit for shipping and storing a light string in accordance with the present invention.
Figure 2:
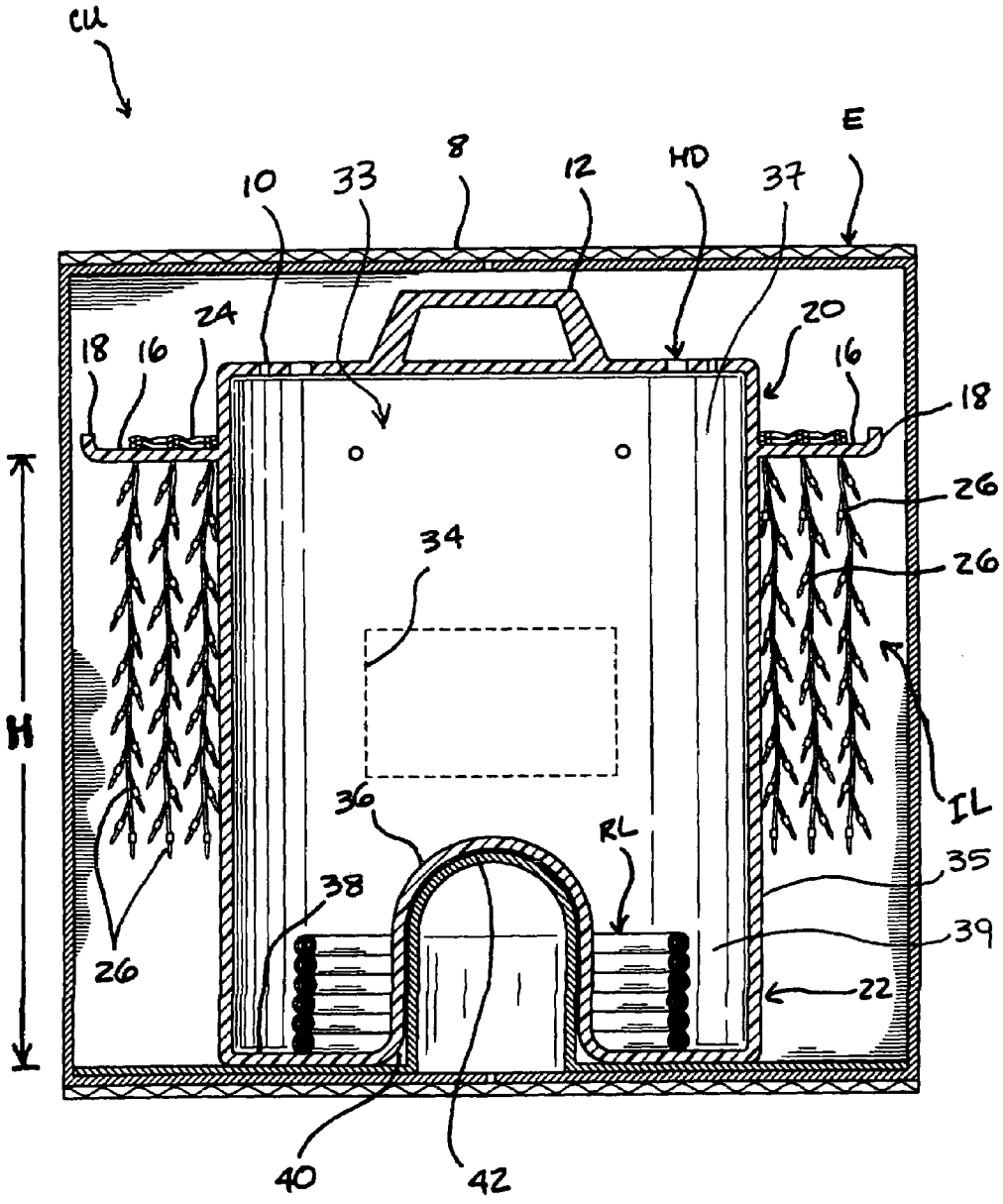
FIG. 2 is a vertical cross-sectional view of the containment unit of FIG. 1, shown with icicle lights and a rope light.
Figure 3:
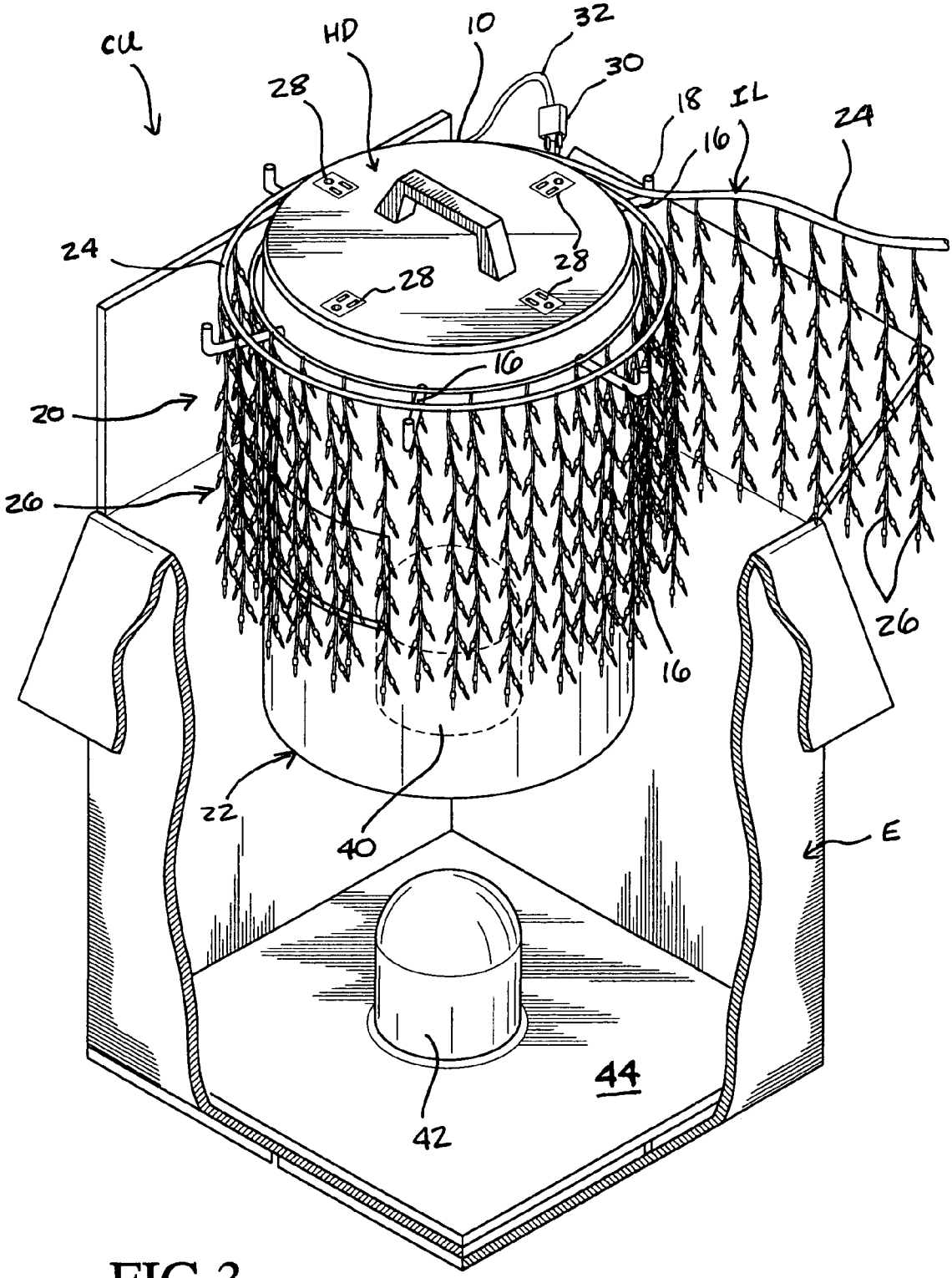
FIG. 3 is an exploded top perspective view of the containment unit of FIG. 1, shown with icicle lights with a portion of the enclosure broken-away to show inside details.

As best shown in FIGS. 1-3, a containment unit CU of the present invention includes a holding device HD within an enclosure E. The enclosure E is preferably in the form a container 8 which can be used to ship the device HD, with or without a decorative light, such as an icicle light string IL, as well as to store the holding device HD, carrying one or more decorative lights.

Figure 4:
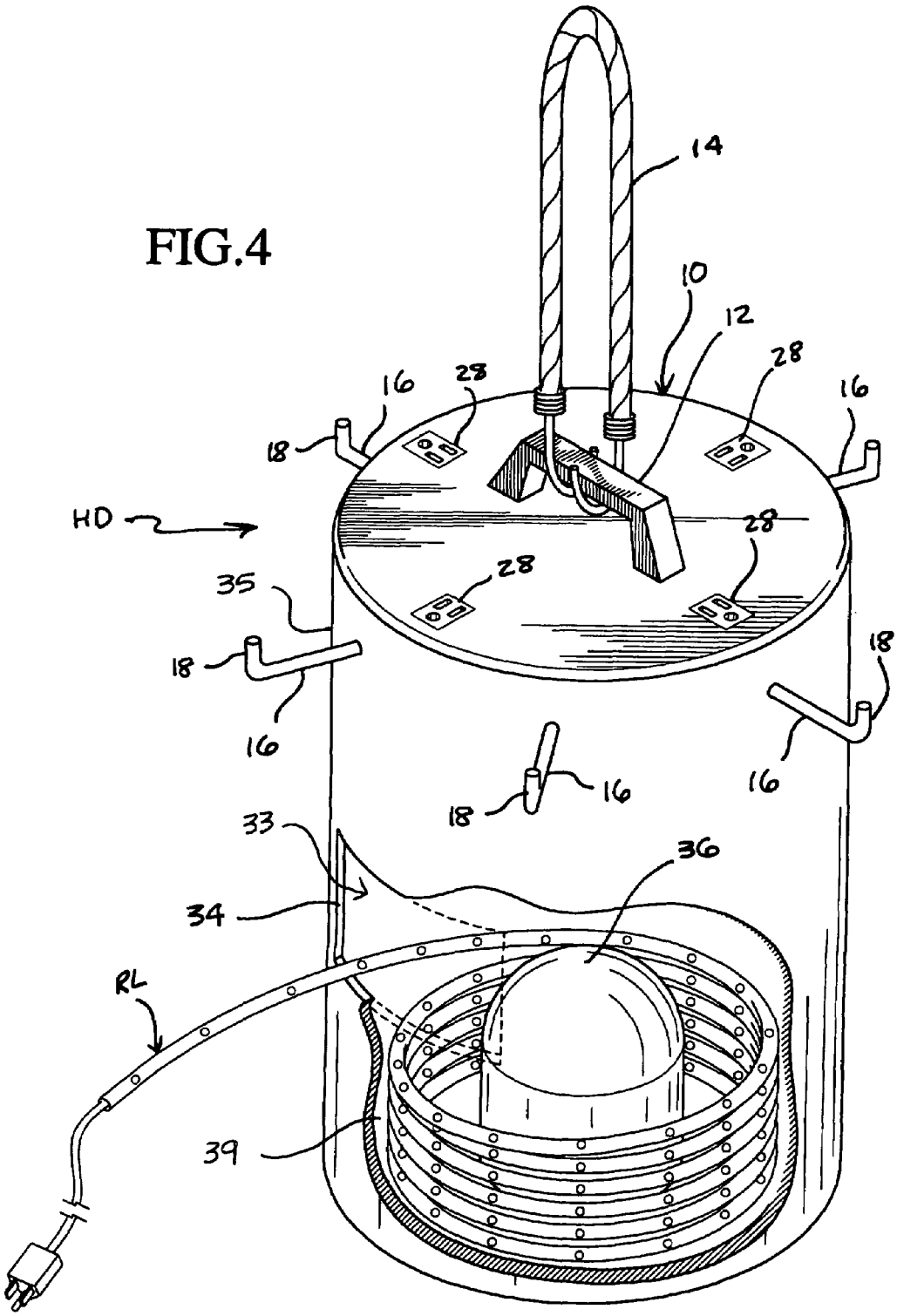
FIG. 4 is a top perspective view of a device for holding a string-like member with a portion broken-away to show storage of a rope light.

As best shown in FIGS. 2-4, the holding device HD of the present invention is in the form of a housing 10, which is preferably a cylindrical container of approximately ten inches in diameter and twenty-two inches tall. The housing 10 includes a handle 12, preferably integrated or disposed on its top for easy turning, handling, and/or lifting, thereof. A cord 14, preferably a Bungi cord, can be inserted into the handle 12 to facilitate easy winding and unwinding of a light and to facilitate hanging from a water spout, a ladder, or other similar device (FIG. 4).

Figure 5:
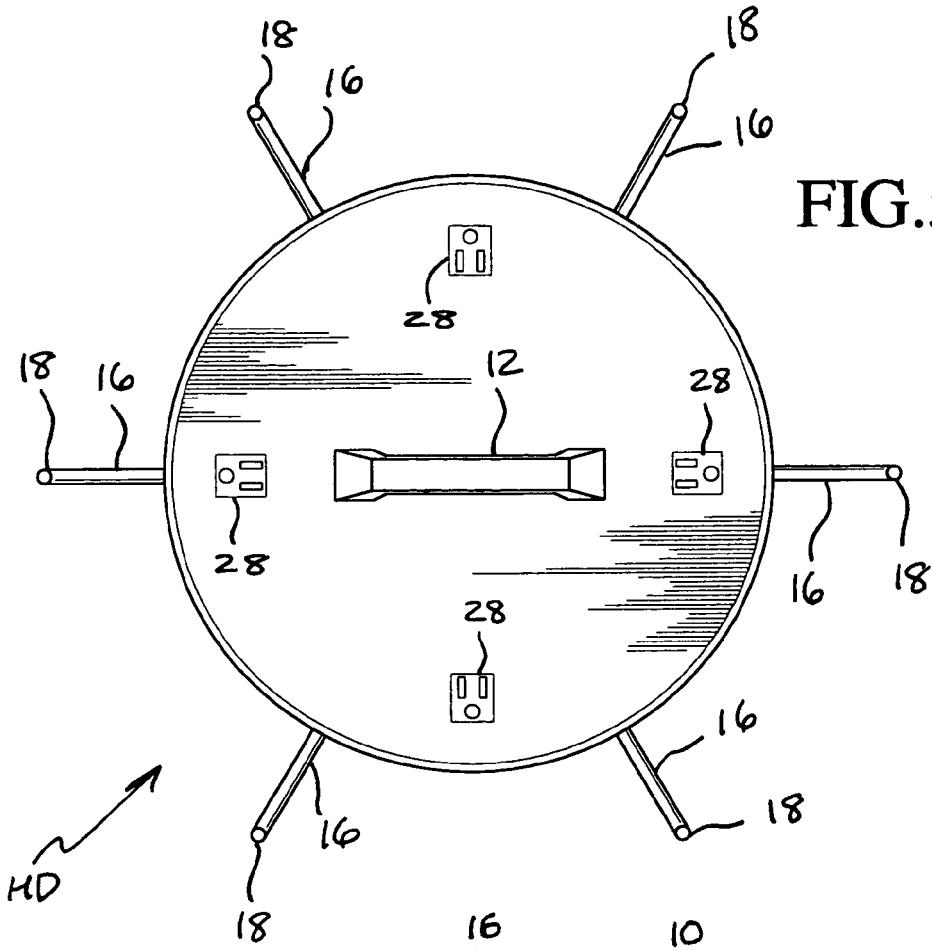
FIG. 5 is a top plan view of the device of FIG. 4.
Figure 6:
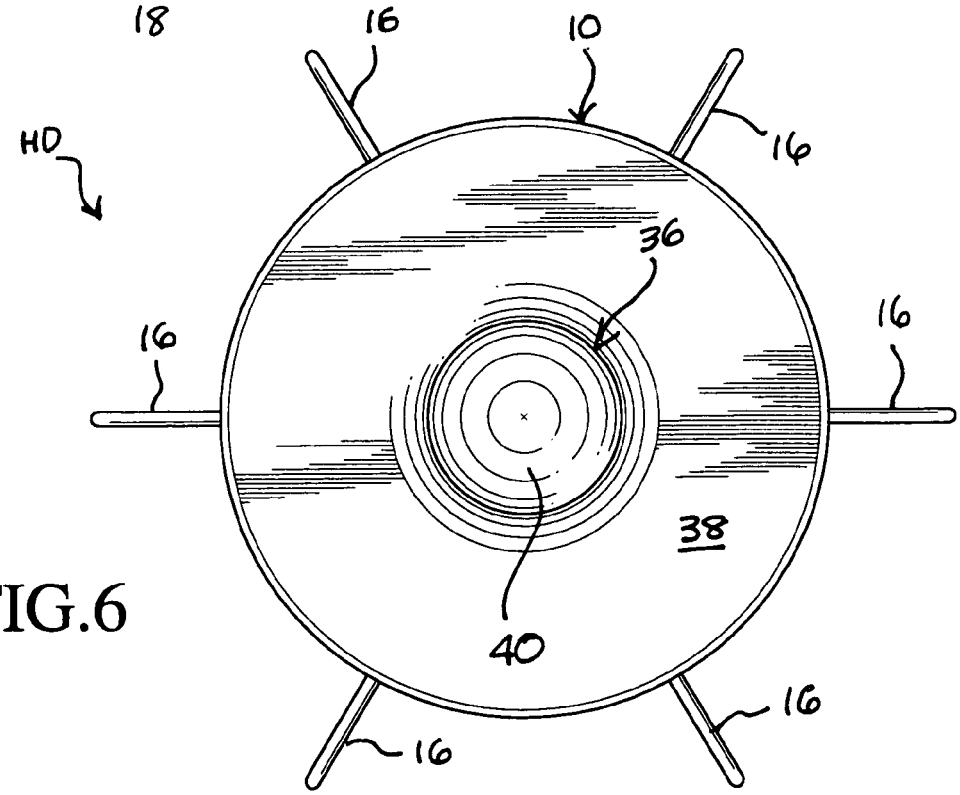
FIG. 6 is a bottom plan view of the device of FIG. 4.

Preferably six hangers 16, each of four inches in length, extend outwardly from the housing 10, and are generally angularly equilaterally spaced from one another (FIGS. 5-6). (It is noted herewith that the number and lengths of the hangers may be varied, as desired.) Each hanger 16 preferably includes a free curved end portion 18 for securing, for example, an icicle light string IL thereon. The icicle light string IL may be wrapped around the housing 10 to be supported on the hangers 16.

As best shown in FIGS. 2-3, the hangers 16 are mounted closer to the top end portion 20 of the housing 10 than the bottom end portion 22 thereof. This facilitates wrapping or winding of the common strand 24 of the icicle light string IL to be supported on the hangers 16, such that icicle-lights or vertical strands 26 thereof hang freely therefrom around the housing 10. In this regard, it is noted that the height H of the hangers 16 on the housing 10 is selected such that the free ends of the icicle-lights 26 stay short of the bottom end portion 22 of the housing 10. This allows the icicle light string IL to maintain its natural form rather than becoming bent, entangled or twisted. A linear-string light or a net light may also likewise be wrapped around the housing 10 and supported by the hangers 16. The preferable length of the hangers 16 allows for the holding of multiple light strings. The free curved end portions 18 stop the light strings from falling off the hangers 16.

As best shown in FIGS. 3-4, the housing 10 includes preferably four female plugs or connectors 28 for coupling to corresponding male plugs or connectors 30 of electrical cords 32. The plugs 28 hold ends of light strings in place while being wrapped around the housing 10 to be supported by the hangers 16 for storage. Although four female plugs are shown, it is within the scope of this invention to vary the number thereof.

As best shown in FIGS. 2 and 4, the housing 10 includes an internal recess 33 and a sidewall 35. The recess 33 is accessible through a side opening 34, which is preferably ten inches wide and eight inches tall, and an upwardly extending female projection 36 on the bottom 38 thereof. The female projection 36 is preferably five inches in diameter and is generally bell-shaped. The female projection 36 may be a separate part attached to the bottom 38 of the housing 10, or may be integrally formed therewith. Preferably, the female projection 36 is a part of the bottom 38 formed into the final shape, and includes an external recess 40 (FIG. 6).

The internal recess 33 includes an upper portion 37, and a lower portion 39 defined by the projection 36 and the sidewall 35. The lower portion 39 is undivided so that a linear-light such as a rope light RL, may easily be guided into the housing 10 through the side opening 34, to be wound or wrapped around the projection 36 for storage. In this manner, the rope-light RL retains its natural form and is kept protected inside the housing 10.

The dimensions of the enclosure E are large enough to enclose the holding device HD and the lights therein. Preferably, the enclosure E is twenty inches in length, twenty inches in width, and twenty-four inches tall. The enclosure E includes an inside male projection 42, which may be integrally formed with the enclosure E, or may be separately formed and then disposed or attached to the bottom 44 thereof (FIG. 3). When the housing 10 is placed into the enclosure E, the male projection 42 is received in the recess 40 of the female projection 36. The external dimensions of the male projection 42 substantially correspond to the dimensions of the recess 40 to ensure a generally tight frictional engagement therebetween so as to immobilize the housing 10 within the enclosure E and to prevent the lights from contacting the inside of the enclosure E. In this regard, it is preferable to provide a small clearance between the curved end portions 18 of the hangers 16 and the inside of the enclosure E to further safeguard against accidental contact of the hangers 16 with the enclosure E. Once immobilized, the containment unit CU and lights are ready for shipping and/or storing.

From the above, it can be observed that the holding device HD can be easily used to, for example, i) store the rope light RL inside the housing 10 by winding around the female projection 36, and ii) support the icicle light string IL on the hangers 16 by winding about the top end portion 20 of the housing. The housing 10 may then be immobilized inside the enclosure E, in the manner discussed above, to be ready for shipping. As noted above, during shipping both the icicle and rope lights would remain in their natural, untangled form.

In order to gain access, a user simple lifts the holding device HD out by grasping the handle 12. Since the lights remain untangled, the user can simple immediately start to decorate a structure, such as the roof of a home, by hoisting the holding device HD up a ladder by a Bungee cord, and unwind the icicle light string IL by gently rotating the housing 10 and laying atop the roof. In this manner, the user simply unwinds the icicle light IL as it is being placed on the roof. Once one or more of the icicle light strings IL are completely removed from the housing 10, the user can gently pull out the rope light RL from inside and through the opening 34 therein to further decorate the same or another structure.

After use, the icicle light string IL and rope light RL can be stored in the housing 10 that can be placed back inside the enclosure E for future use. As can be seen, the holding device HD of the present invention makes it fast and easy to store various decorative lights, keeps the lights protected and in untangled, untwisted form, and allows for easy decoration of a structure.

While this invention has been described as having preferred sequences, ranges, steps, materials, structures, components, features, and/or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbeforesefforth and fall within the scope of the invention and of the limits of the appended claims.

What I claim is:

1. A device for holding a string member, comprising:

a) a housing including a sidewall and an internal recess;

b) an inside member positioned in said internal recess;

c) a plurality of hangers extending outwardly from said housing;

d) said internal recess including upper and lower portions; and e) said lower portion of said recess defined by said inside member and said sidewall being undivided to accommodate a string member.

2. The holding device of claim 1, wherein:

a) said housing includes a bottom; and b) said inside member extends from said bottom.

3. The holding device of claim 2, wherein:

a) said housing includes a side opening for guiding the string member therethrough to be wound about said inside member.

4. The holding device of claim 3, wherein:

a) said inside member is integrally formed with said housing.

5. The holding device of claim 3, wherein:

a) said inside member is generally bell-shaped.

6. The holding device of claim 1, wherein:

a) said housing includes upper and lower end portions; and b) said hangers are disposed on said housing closer to said upper end portion than said lower end portion thereof;

c) whereby an icicle light string can be supported on said housing by winding about said upper end portion thereof in a manner that icicle-lights hang from said hangers.

7. The holding device of claim 6, wherein:

a) one of said hangers is at least one inch in length.

8. The holding device of claim 6, wherein:

a) one of said hangers includes a free curved end portion for securing the icicles thereon.

9. The holding device of claim 8, wherein:

a) three of said hangers are angularly equilaterally spaced from one another and extend from the exterior of said housing.

10. The holding device of claim 8, wherein:

(a) six of said hangers are angularly equilaterally spaced from one another and extend from the exterior of said housing.

11. The holding device of claim 8, wherein:

a) said housing is generally cylindrical in shape.

12. The holding device of claim 1, wherein:

a) said housing includes a recess for receiving an end of the string member.

13. The holding device of claim 1, in combination with an enclosure for storing the device.

14. A device for holding a light string, comprising:

a) a generally cylindrical housing including a side opening for guiding a first light string thereinto; and b) said housing including an inside bottom projection for winding the first string thereabout for storage;

c) a plurality of angularly equilaterally spaced hangers extending outwardly from the exterior of said housing for holding a second light string; and d) the second light string including a plurality of icicle-light strands connected to a common strand;

e) whereby the second light string can be wound about said housing in a manner that the common strand is supported on said hangers and the icicle-light strands hang freely therefrom.

15. The holding device of claim 14, in combination with an enclosure for storing the device.

16. The holding device of claim 15, wherein:

a) said enclosure includes an inside member for immobilizing the device within said enclosure.

17. The containment unit of claim 16 wherein:

a) said enclosure includes a bottom; and b) said inside member extends from said bottom.

18. The containment unit of claim 17, wherein:

a) said inside member is integrally formed with said enclosure.

19. The containment unit of claim 17, wherein:

a) said device includes a recess for receiving said inside member.

20. The containment unit of claim 19, wherein:

a) said recess is generally bell-shaped.

21. The containment unit of claim 15, wherein:

a) said enclosure includes a shipping container reusable as a storage container.

* * * * *